US012486734B1

(12) United States Patent
Moeller

(10) Patent No.: US 12,486,734 B1
(45) Date of Patent: Dec. 2, 2025

(54) USE OF TURBULENT FLOW IN A FRAC PLUG

(71) Applicant: Halliburton Energy Services, Inc., Houston, TX (US)

(72) Inventor: Daniel Keith Moeller, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/827,483

(22) Filed: Sep. 6, 2024

(51) Int. Cl.
*E21B 17/042* (2006.01)
*E21B 33/128* (2006.01)

(52) U.S. Cl.
CPC ..... *E21B 33/1285* (2013.01); *E21B 17/042* (2013.01)

(58) Field of Classification Search
CPC .. E21B 17/042; E21B 33/128; E21B 33/1285; E21B 33/129; E21B 33/1295
See application file for complete search history.

(56) References Cited

U.S. PATENT DOCUMENTS 9,151,430 B2 * 10/2015 Wium ..... F16K 47/06
11,549,332 B2 * 1/2023 El Mallawany ..... E21B 43/12
2012/0145378 A1 6/2012 Frazier
2018/0051532 A1 2/2018 Smith et al.
2018/0106129 A1 4/2018 Wise
2021/0054718 A1 * 2/2021 Harrigan ..... E21B 34/10
2021/0238958 A1 8/2021 Stolboushkin et al.
2023/0144473 A1 5/2023 Gillis et al.

OTHER PUBLICATIONS

"PCT Application No. PCT/US2024/047514 International Search Report and Written Opinion", May 29, 2025, 11 pages.

* cited by examiner

*Primary Examiner* — Matthew R Buck
(74) *Attorney, Agent, or Firm* — DeLizio, Peacock, Lewin & Guerra LLP

(57) ABSTRACT

Provided herein are embodiments of a frac plug for use downhole in a wellbore, a system, and a method for creating a pressure differential in the wellbore or performing an operation downhole in the wellbore. In one embodiment a plug for use within a wellbore comprises a mandrel; and a flow restrictor positioned within an inner diameter of the mandrel. In one embodiment, a method may include positioning a frac plug at a depth inside a casing of a wellbore formed in a subsurface formation, wherein one or more components are coupled with the frac plug, the frac plug comprising: a mandrel; and a flow restrictor positioned within the mandrel; setting the frac plug to contact an inner wall of the casing; and creating a pressure differential within the wellbore with the flow restrictor of the plug.

9 Claims, 5 Drawing Sheets

USE OF TURBULENT FLOW IN A FRAC PLUG

TECHNICAL FIELD

This disclosure relates generally to the field of hydraulically fracturing a wellbore in a subsurface formation and more particularly to the field of frac plugs.

BACKGROUND

In hydrocarbon recovery operations, fluid and sand may be pumped into a wellbore to hydraulically fracture a subsurface formation. The pump rate and pressure from the fluid may fracture the subsurface formation, creating a conduit for the fluid in the subsurface formation to flow to the wellbore and ultimately to the surface. Sand may be pumped with the fluid and placed into the fractures to support said fractures. A wellbore may be hydraulically fractured in one or more stages, where each stage includes clusters of perforations in which the fluid and sand may enter the subsurface formation to fracture said subsurface formation. A frac plug may be positioned between stages to prevent hydraulic communication between stages. There is a need for a simple and elegant method to shut off the flow of frac fluid through the inner diameter (ID) of a frac plug autonomously. Disclosed herein are several different methods for shutting off the flow of frac fluid through a frac plug.

BRIEF DESCRIPTION OF THE DRAWINGS

Implementations of the disclosure may be better understood by referencing the accompanying drawings.

DESCRIPTION

Figure 1:
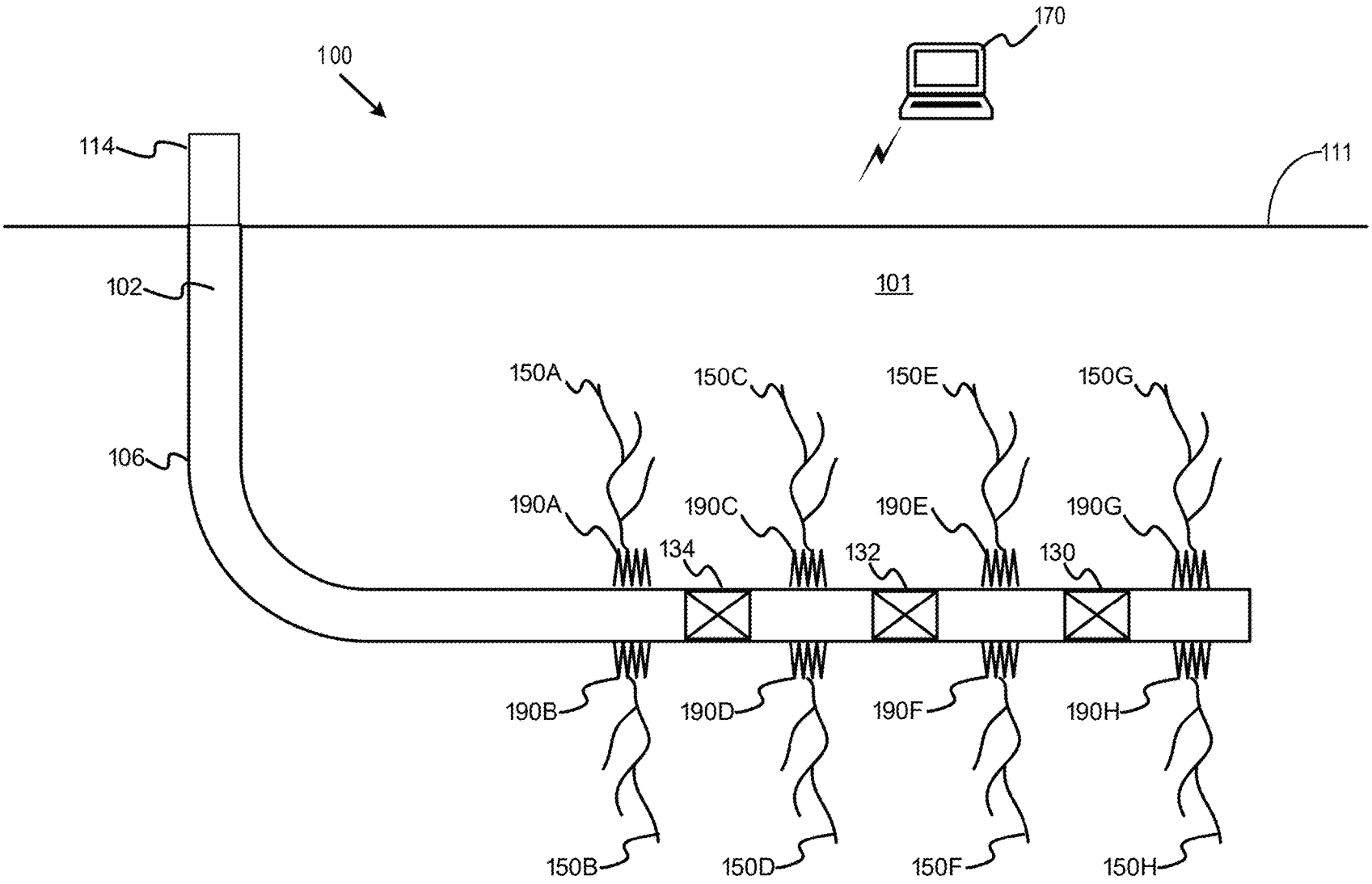
FIG. 1 is an illustration depicting an example well system, according to some implementations.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

The description that follows includes example systems, methods, techniques, and program flows that embody aspects of the disclosure. However, it is understood that this disclosure may be practiced without these specific details. For instance, this disclosure refers to a hydraulic fracturing (frac) plug utilized during hydraulic fracturing operations. Aspects of this disclosure can also be applied to any other scenarios where a frac plug may be utilized in a wellbore. For clarity, some well-known instruction instances, protocols, structures, and operations have been omitted.

Example implementations relate to a frac plug and structures and methods for shutting off the flow of frac fluid through the inner diameter (ID) of a frac plug autonomously. The methods disclosed herein include using fluidic valves and pressure restriction methods to create a pressure barrier and/or to cause a pressure drop or pressure differential downhole, without the need for dropping a ball or other sealing object/device to seal off the plug.

Frac plugs may be utilized in hydraulic fracturing operations to hydraulically isolate frac stages. Frac plugs may also serve as check valves to provide wellbore zonal isolation in multistage stimulation treatments. They isolate the lower zone during stimulation but allow flow from below to aid in well cleanup once the stimulation is over. A frac plug may be positioned in the casing of a wellbore during hydraulic fracturing operations. A setting assembly may set the frac plug at the desired depth such that the frac plug is held in place in the casing. The casing may then be perforated, in some examples. An isolating component, such as a sealing device (e.g., a cone shaped device, egg shaped device, ball, dart, etc.), may then be positioned in the frac plug to seal off an uphole end of the plug to restrict the flow of fluid through the plug and hydraulically isolating the portion of the wellbore below the frac plug (i.e., at depths greater than the frac plug) from the portion of the wellbore above the frac plug (i.e., depths less than the frac plug towards the wellhead).

Traditional flow restrictors exist in the market but usually consist of check valves or mechanism based methods, such as a ball or sealing object. Flow restrictors comprising autonomous valve methods do not appear to exist in the market for frac plugs for at least two reasons: 1) the computation power to design and develop the autonomous fluidic valves is a barrier to usage for most marketed products, and 2) the manufacturing methods required to create the valves is a barrier to entry at scale. For instance, a "Tesla Valve" can be manufactured in a flat two-dimensional (2D) version relatively easily, but cannot be easily and cheaply manufactured in cylindrical form. Three-dimensional (3D) printing at scale has moved such previously "impossible" geometry systems into the realm of capability while also allowing production at scale.

In addition to the improvements discussed herein, the use of a helical tortuous path may enable work to be performed through the generation of rotational motion. The rotational motion can be used to perform downhole functions for a plug including fluidic pulsing, mechanical movement, as will be shown with one embodiment herein, or perhaps the opening or closing of an actuation fluid reservoir for near bore pH changes or acidic dissolution of materials.

The movement within the frac plug market to commoditization has driven toward efficient geometries for the performance as temporary barriers. Finding alternate methods to differentiate by adding functionality or novel uses allows for broader use and marketing of the temporary barrier plugs as non-commoditized products.

Disclosed herein are embodiments of a frac plug having an autonomous flow restrictor. The plug may comprise a mandrel having a length and a flow restrictor positioned within and comprise the length of an inner diameter (ID) of the mandrel and eliminate the need for a sealing device, such as, e.g., a ball. The mandrel may be constructed similar to a conventional frac plug, having a setting element and other features used for positioning and setting the plug into the casing. Different embodiments of the flow restrictor are described herein. In one embodiment, the flow restrictor may include a rotor drive system to actuate a muleshoe positioned in a downhole end of the plug. A work performing rotor device may or may not activate with the help of stator geometry on the inside of a frac plug mandrel. The stator may be used when larger speeds or torques are required. In some embodiments, the muleshoe is threaded and is coupled about a rod, the rod comprising a downhole end of the rotor. The rod may be coupled in some examples with other components, and the rod may translate motion to the other components. The rod may be coupled with another tool downhole of the plug. In some implementations, the plug may be coupled with another downhole tool and the rotation movement may be used to perform one or more downhole functions.

In another embodiment, the flow restrictor may comprise a tortuous flow path method created by an inner geometr of the mandrel where the fluid restrictions will ultimately limit the flow of fluid at high flow rates. The tortuous flow path may be defined by the geometric pattern. In some examples, the geometric pattern includes a plurality of opposing substantially right angles, wherein a substantially right angle is within about 10% of a 90 degree angle. For example, the angle may be between about 80 degrees and about 100 degrees and still provide the needed geometry to limit fluid flow through the plug.

In yet another embodiment the flow restrictor may comprise a valvular conduit, such as a "Tesla Valve" where the valvular conduit is configured to create a turbulent flow in a primary flow direction. Creation of turbulent flow in the valve will hinder the laminar flow of fluid through the ID of the mandrel. If fluid flows from downhole in a reverse (uphole) direction, the flow will continue with minimal additional restriction.

Example System

FIG. 1 is an illustration depicting an example well system 100, according to some implementations. Well system 100 includes a wellbore 102 in a subsurface formation 101. The wellbore 102 includes casing 106 and a number of perforations 190A-190H being made in the casing 106 at different depths to allow reservoir fluids (i.e., oil, water, and gas) from the subsurface formation 101 to flow into the wellbore 102. During hydraulic fracturing operations of the wellbores 102, fracturing fluid, with or without sand, may be pumped into the subsurface formation 101, via the perforations 190A-190H, to generate fractures 150A-150H in the subsurface formation such that reservoir fluid may flow into the wellbore 102.

In some implementations, the wellbore 102 may be hydraulically fractured in stages. For example, a first stage may include hydraulically fracturing the perforations 190G, 190H to generate fractures 150G, 150H, respectively. After the hydraulic fracturing operations for the first stage are complete, a frac plug 130 may be positioned in the casing 106 above the first stage (i.e., at a lesser depth in the wellbore than perforations 190G, 190H). The frac plug 130 may be positioned in the wellbore 102 via any suitable setting method such as wireline. In some implementations, the frac plug 130 may be set by expanding such that the outer face of the frac plug 130 may come into contact with the inner wall of the casing 106, thus holding the frac plug 130 in place. A setting tool on the wireline may press the inner diameter of the frac plug 130 to expand and set the frac plug 130. Once set, an isolating component may be positioned (e.g., dropped/released from a setting kit in the wellhead 114 or other location on surface 111) in the frac plug 130 to prevent hydraulic communication between the portion of the wellbore 102 below the frac plug 130 (i.e., the first stage that was hydraulically fractured) and the portion of the wellbore 102 above the frac plug 130. Once the sealing component is positioned in the frac plug 130, the perforations 190E, 190F may be formed in the casing 106 and hydraulic fracturing operations may commence for the next stage. Similar operations may be repeated for each subsequent stage (i.e., setting frac plug 132 and frac plug 134 and hydraulically fracturing the next subsequent stage) until hydraulic fracturing operations for the wellbore 102 are complete.

Example Frac Plugs

Examples configurations of frac plug are now described. The frac plugs are described in reference to the frac plugs 130-134 of FIG. 1.

Figure 2A:
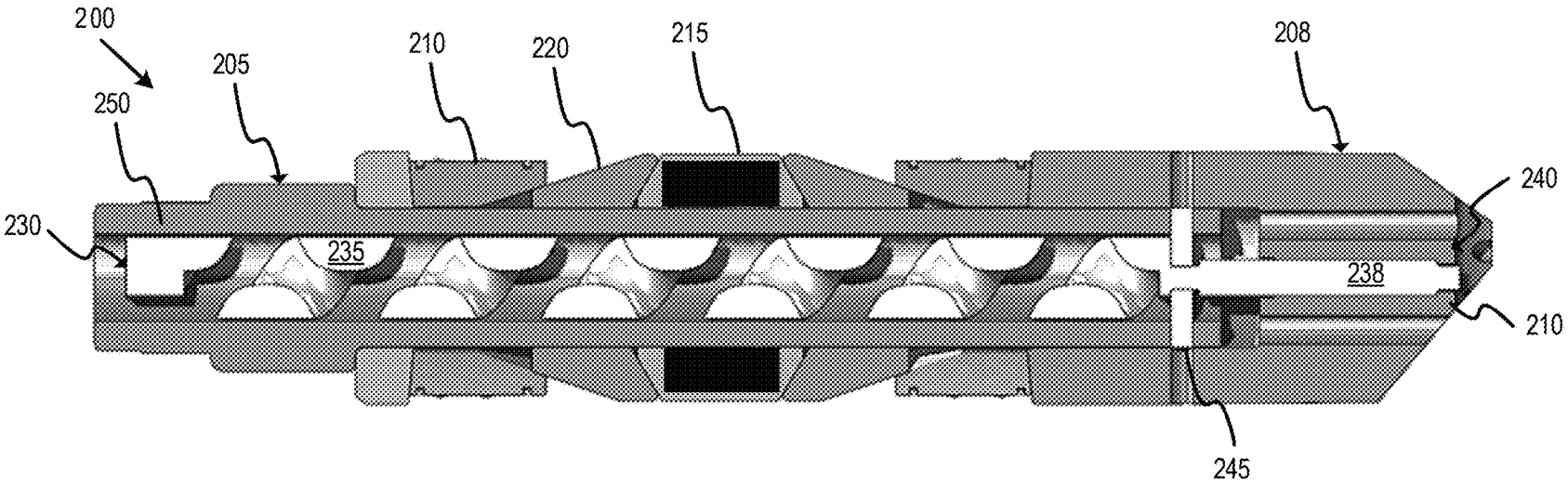
FIGS. 2A and 2B illustrate one embodiment of a frac plug designed and manufactured according to one or more embodiments of the disclosure.
Figure 2B:
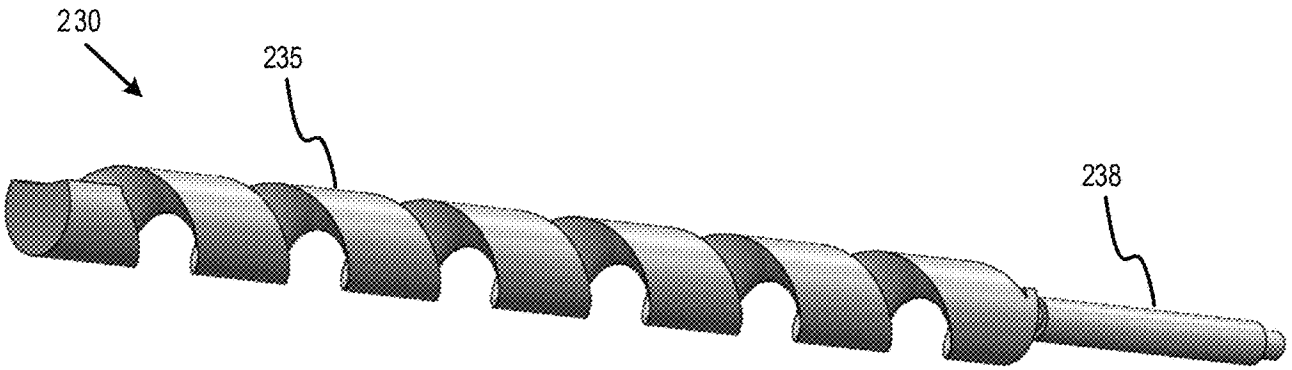

FIG. 2A-2B illustrate one example of a frac plug 200, according to some implementations. FIG. 2A is a cross-section view of the frac plug 200. The frac plug 200 has an outer mandrel 205 having example components thereabout for setting the plug 200 into a casing. The outer mandrel and components are similar to those used in traditional frac plugs. In this example, the components include slips 210, an element 215, and wedges 220 positioned on both sides of the element 215. The frac plug 200 includes a flow restrictor 230 positioned within the inner diameter (ID) of the frac plug 200. The flow restrictor 230, may in some examples, be constructed with and comprise the ID of the mandrel 205.

The flow restrictor 230 includes a rotor drive system including a rotor 235 coupled with a muleshoe 240 positioned at a downhole end 208 of the plug 200. In this embodiment, the rotor 235 includes a rod 238 at a downhole end thereof, coupled with and extending through the muleshoe 240. At low fluid velocities (in some examples, at or below 150 gallons per minute), the fluid will pass directly through as shown by flow arrow F, at medium fluid velocities the rotor 235 will rotate and compress (flow down-hole) or decouple (flow up-hole) the muleshoe 240 from the lower slips 210. At high flow rates (in some examples, about 320-350 gallons per minute, but this may differ according to the wellbore application or activity), the turbulent flow will block the fluid transmission and act as a barrier (ball on seat) to fluid flow through the mandrel 205. In this example, the flow restrictor 230 is held in place within the mandrel by pins 245, but other retaining members or mechanism to translate linear motion and hold the rotor in place may be used (e.g. plate, bearings, other forms of pins) The pins 245 do not affect rotation of the rotor 235 and do not affect the function of the flow restrictor 230. In this example, a downhole end 208 of the mandrel 205 has a threaded inner diameter (ID), but in other examples, the downhole end 208 of mandrel 205 may not include threading on the ID. Although example ranges are provided for low and high rates, these flow rates are not restrictive or exclusive and may vary according to the wellbore activity or application in which the plug 200 may be used.

The work performing rotor 235 may or may not activate with the help of a stator 250 and geometry inside of the plug 200. The stator 250 can be used when larger speeds or torques are required. Fluid flow through the rotor 235 will turn the rotor 235 and the adjacent the threaded downhole end 208 of mandrel 205. The threaded mandrel 205 may either have a left or right handed thread as needed to move the muleshoe 240 up or down the mandrel 205 as required. The muleshoe 240 may be interlocked to the slips to allow for the relative motion between the rotor, mandrel, and the muleshoe 240. In this embodiment, the plug will not have a change in the pressure decreased from the reverse (downhole) direction. This allows the rotor 235 to rotate the engagement threads within the downhole end 208 of the mandrel 205 and "unscrew" the muleshoe 240 from the mandrel 205 and enable the detachment and desupporting of the outer components of the plug 200 from the mandrel 205.

FIG. 2B is a perspective view of the flow restrictor 230, showing the rotor 235 and rod 238. The rod 238 may couple with another tool downhole of the plug 200. In some implementations, the rotation of the rotor 235 and rod 238 may transfer rotation to the another downhole tool coupled with the rod 238 for performing another downhole operation using rotation from the rotor 235. Some examples of downhole operations may include fluidic pulsing, mechanical movement, or opening or closing of an actuation fluid valve for additional operations such as near bore pH changes or acidic dissolution of materials. Further, the operation may allow for the decoupling of the previous run plug (such as plug 130 in FIG. 1) by the actuation of the uphole plug (such as plug 132). Additionally, the wellbore may need to have a active shut in valve available for temporary well control that could be actuated with the run in hole plug.

Figure 3A:
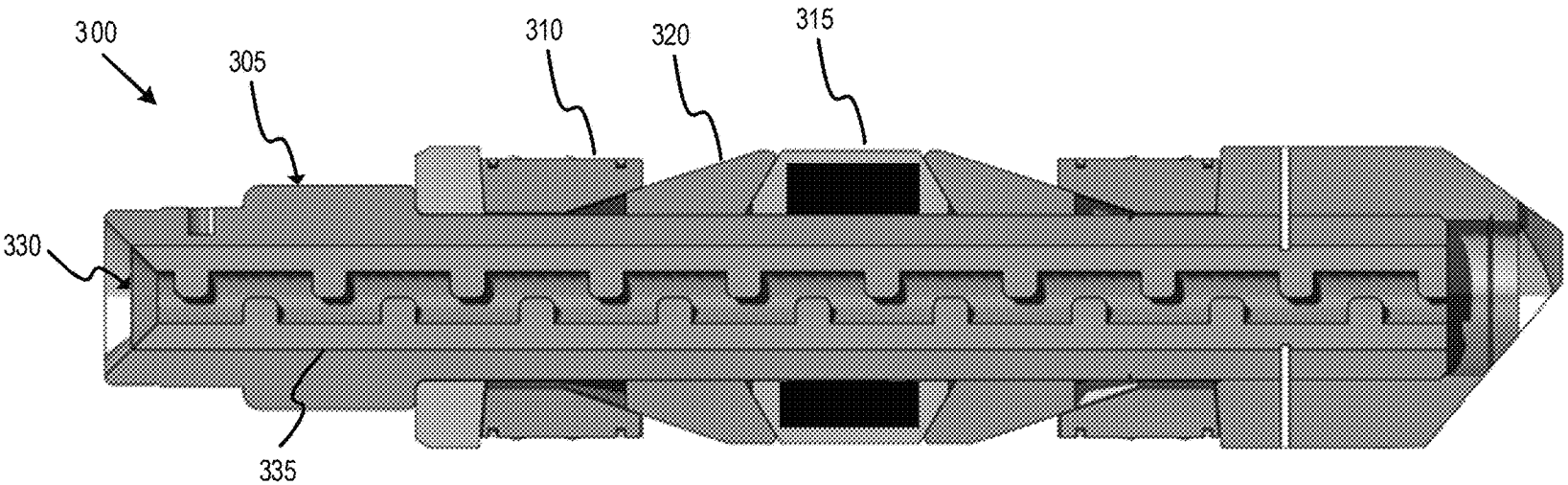
FIGS. 3A and 3B illustrate another embodiment of a frac plug designed and manufactured according to one or more embodiments of the disclosure.
Figure 3B:
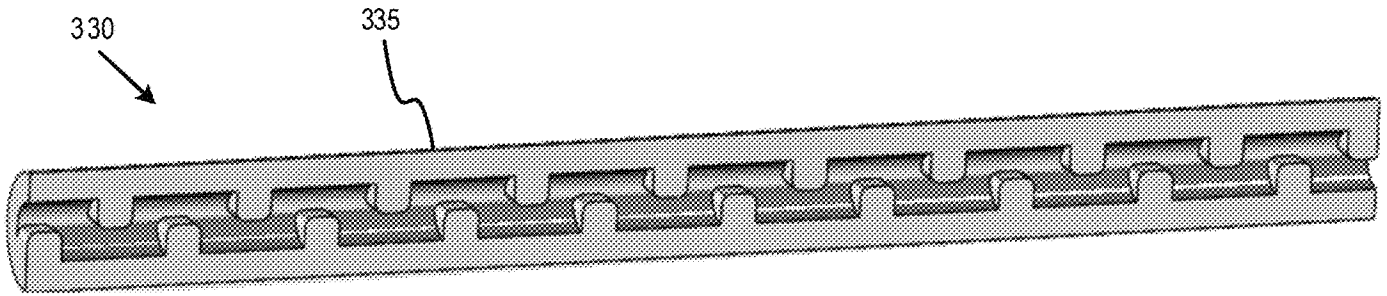

FIGS. 3A and 3B illustrate another example frac plug 300. FIG. 3A is cross section view of frac plug 300. The frac plug 300 may similarly include an outer mandrel 305 having similar components as frac plug 200 for setting the plug 300 into a casing. Frac plug 300 differs from frac plug 200 in that a flow restrictor 330 may be positioned within or comprise an ID of the mandrel 305.

In this example, the flow restrictor 330 comprises a geometric pattern 335. The flow restrictor 330, in some implementations, may be fabricated at a manufacturing facility and installed in the plug 300 offsite, or may be fabricated on site using a 3D printing process. The flow restrictor 330 may comprise elastomers, plastics (Thermoplastics or Thermosets), metals or composites that may include drillable or millable metals such as aluminum or cast iron. The geometric pattern 335 may include a plurality of angles to create the tortuous flow path. In this example, the angles are opposing right angles. The angles may be 90 degree right angles, or may be substantially right angles, such as within about 10% of a 90 degree angle. For example, the angles may be between about 80 degrees and about 100 degrees and still provide the needed geometry to provide a tortuous flow path and limit fluid flow through the plug 300.

A tortuous flow path is used to restrict and eventually disable the flow of fluid through the ID of the frac plug 300 based on fluid rate applied. The tortuous path causing fluid restrictions provided by this example will ultimately limit the flow of fluid through the plug at high flow rates. Similar to the plug 200, this example plug 300 creates a pressure barrier/drop or differential in a downhole direction, but also does have a change in the pressure decrease from the reverse direction (uphole direction). This embodiment focuses primarily as an autonomous method to shut off flow through the ID of the mandrel 205 and replace the ball or object in ball drop or Ball-in-Place (BIP) operations, which can save time and money for the drilling operation on location. For example, in a typical installation, the process for dropping a ball or object to shut off flow through a plug may take significant time per plug, such that in an installation with multiple plugs, the time consumed by dropping an object or ball in hole can be time-consuming. By employing a plug such as plug 200 or 300, time and money may be saved for the wellbore installation and operation.

Figure 4A:
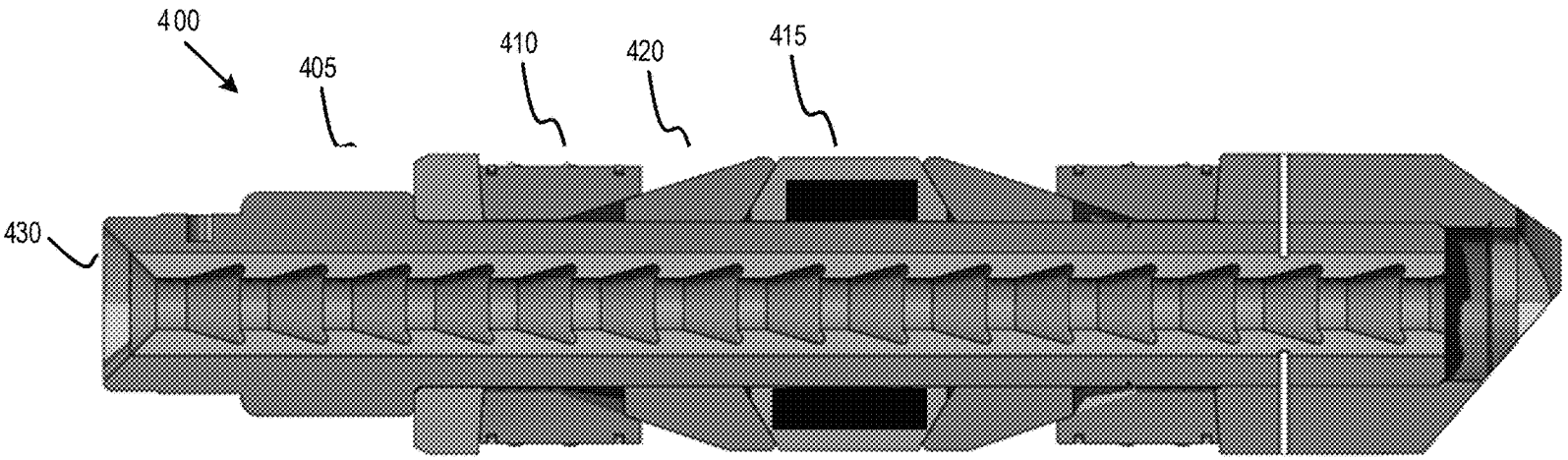
FIG. 4A-4C illustrate yet another embodiment of a frac plug designed and manufactured according to one or more embodiments of the disclosure.
Figure 4B:
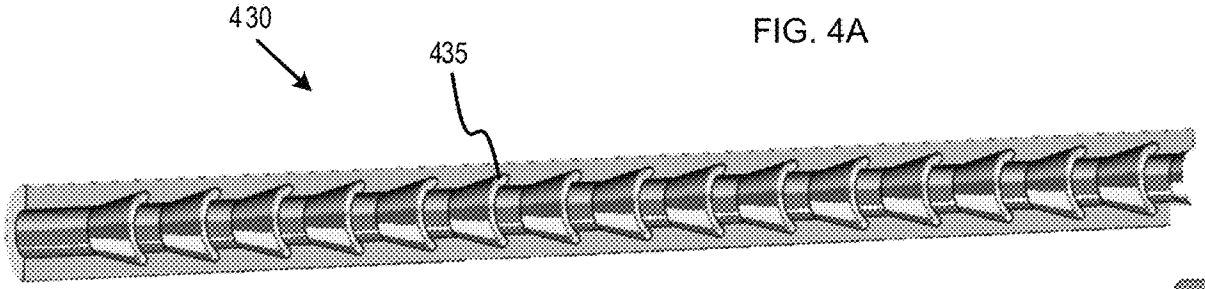
Figure 4C:
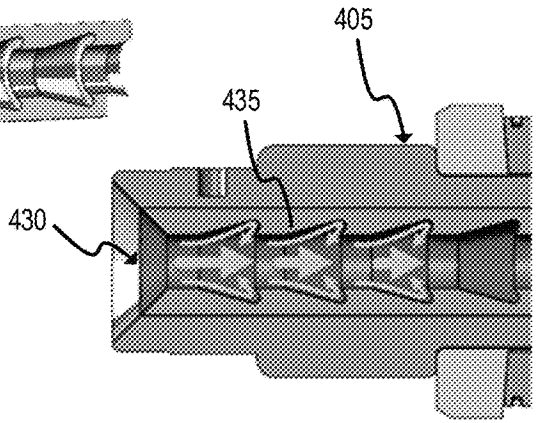

FIG. 4A-4C illustrate another example frac plug 400, according to some implementations. FIGS. 4A and 4C are a cross section view of the frac plug 400. The frac plug 400 may be similar to the frac plugs 200 and 300 of FIGS. 2A and 3A, having a mandrel 405 with additional components on an exterior surface, but comprises flow restrictor 430 having a different configuration than flow restrictors 230 and 330. The flow restrictor 430 in this embodiment includes a valvular conduit configured to create a turbulent flow in a primary direction, such as a tesla valve 435 positioned within the ID of the mandrel 405.

FIG. 4B is a perspective view of the tesla valve 435.

FIG. 4C illustrates an example of the tortuous flow path through the tesla valve 435 or valvular conduit. The tesla valve 435 is a fixed geometry passive check valve used to restrict and eventually disable the flow of fluid through the ID of the frac plug 400 based on fluid rate applied. The creation of turbulent flow in the tesla valve 435 will hinder the laminar flow passage through the ID of the mandrel 405. As shown in FIG. 4C, turbulent flow will come back at the laminar flow through the center. As the fluid moves down the mandrel 405 it will slow due to the accumulated pressure drops. In some examples, a turbulent flow to initiate an autonomous check valve may be higher than 350 gallons per minute.

The tesla valve 435 works as an autonomous method to shut off flow through the ID of the mandrel 405 and replace ball or object drop, saving time and money not only for subsequent post-frac drilling operations on location, but also for all unencumbered production during post-frac operations. In this example, unlike in the plugs 200 and 300, flow in the reverse (uphole) direction the flow may continue with minimum restrictions. This provides an advantage over traditional frac plugs requiring a ball or object to block the plug, because while the ball or object is in place, no flow is allowed in either direction, downhole or uphole. This example plug 400 enables pressure drop from uphole in a downhole direction while allowing fluid to flow from downhole in an uphole direction.

Example Operations

Examples operations are now described.

Figure 5:
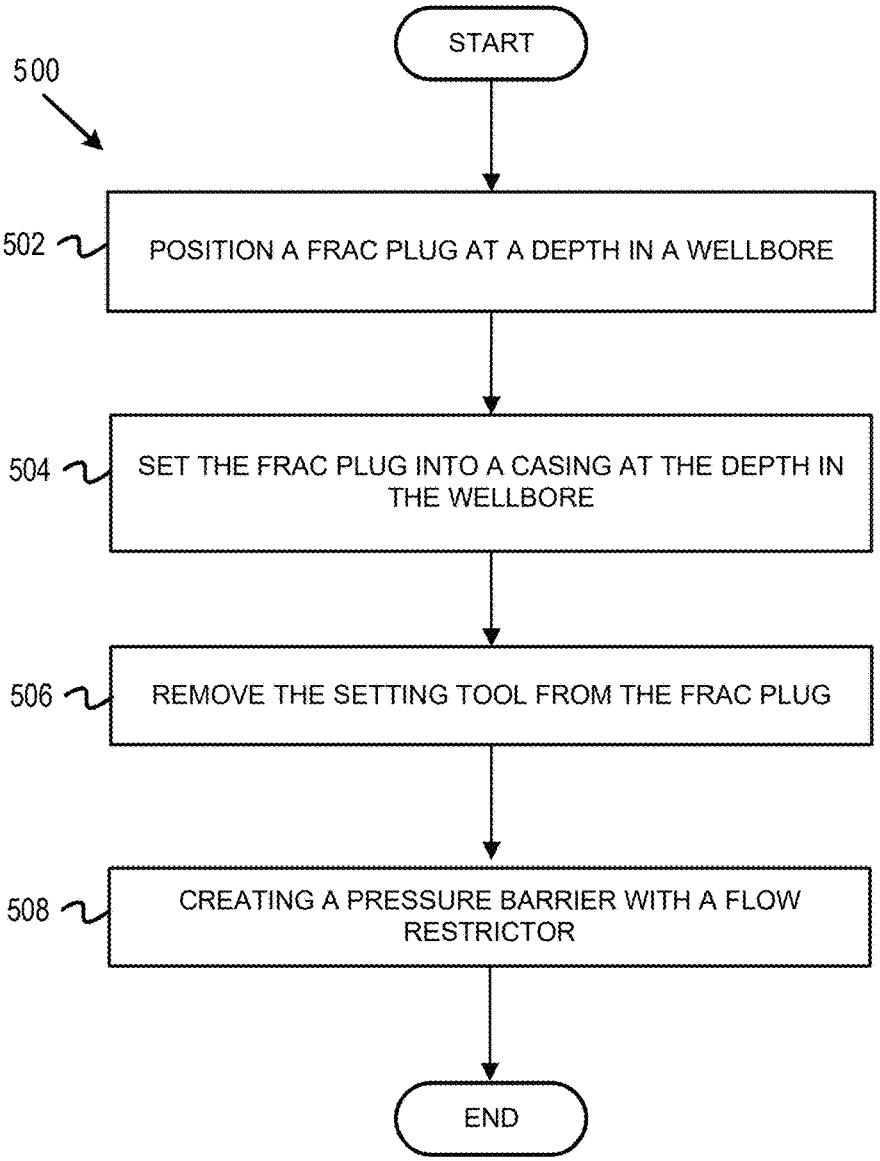
FIG. 5 is a flowchart depicting example operations for creating a pressure differential in a wellbore using embodiments of a frac plug, according to the disclosure.

FIG. 5 is a flowchart 500 depicting example operations for creating a pressure barrier or pressure differential in the wellbore, according to some implementations. The operations of flowchart 500 are described in reference to the expandable frac plugs 200-400 described in FIGS. 2A-4C, respectively.

At block 502, a frac plug, such as any of frac plugs 200-400, is positioned at a depth within a wellbore.

At a block 504, the plug is set into a casing within the wellbore.

At a block 506, the setting tool is removed from the wellbore.

At block 508, a pressure barrier is created with a flow restrictor in the plug. No ball or object drop is needed. Operation of the different examples of flow restrictors is discussed above with respect to example plugs 200, 300, and 400. As discussed above, as fluid flow increases, the flow restrictor creates a turbulent or tortuous flow path, resulting in the flow restrictor acting as an autonomous check valve such, creating a pressure drop such that fluid will no longer flow through the plug. In some examples, fluid may still be able to flow uphole through the plug, but the tortuous flow path creates a pressure barrier or pressure different and fluid no longer flows downhole through the plug in most implementations.

While the aspects of the disclosure are described with reference to various implementations and exploitations, it will be understood that these aspects are illustrative and that the scope of the claims is not limited to them. In general, techniques for setting a frac plug herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subsurface formation" shall be construed as encompassing both areas below exposed earth and areas below earth covered by water such as ocean or fresh water.

Example Aspects and Implementations

Aspect A: A plug for use within a wellbore, the plug comprising at least: a mandrel; and a flow restrictor positioned within an inner diameter of the mandrel.

Aspect B: A system comprising at least: a wellbore; at least one frac plug positioned within a casing of the wellbore, the frac plug including, a mandrel, the mandrel including one or more components for holding the frac plug in a position within the wellbore casing; and a flow restrictor positioned within the mandrel.

Aspect C: A method comprising at least: positioning a frac plug at a depth inside a casing of a wellbore formed in a subsurface formation, wherein one or more components are coupled with the frac plug, the frac plug comprising: a mandrel; and a flow restrictor positioned within the mandrel; setting the frac plug to contact an inner wall of the casing; and creating a pressure differential within the wellbore with the flow restrictor of the plug.

Aspects A, B, and C may have one or more of the following additional elements in combination:

Element 1: wherein the flow restrictor includes a rotor to actuate a muleshoe positioned in a downhole end of the plug.

Element 2: wherein a the muleshoe is threaded and coupled about a rod comprising a downhole end of the rotor.

Element 3: wherein the rod is coupled with another tool downhole of the plug.

Element 4: wherein the flow restrictor comprises a tortuous flow path.

Element 5: wherein the tortuous flow path is defined by a geometric pattern.

Element 6: wherein the geometric pattern includes a plurality of opposing substantially right angles.

Element 7: wherein the flow restrictor comprises a valvular conduit configured to create a turbulent flow in a primary direction through the mandrel, wherein in some embodiments, the valvular conduit may be a tesla valve.

Element 8: wherein the flow restrictor includes a rotor to actuate a muleshoe and rod positioned in a downhole end of the plug, wherein creating a pressure differential includes initiating fluid flow through the plug, the fluid flow generating rotational motion by the rotor.

Element 9: further comprising using the rotational motion of the rotor to perform a downhole operation.

Element 10: wherein the flow restrictor comprises a tortuous flow path, wherein the tortuous flow path is defined by a geometric pattern, wherein the geometric pattern includes a plurality of opposing substantially right angles.

Element 11: wherein the flow restrictor comprises a valvular conduit configured to create a turbulent flow in a primary direction through the mandrel. In some embodiments, the valvular conduit may be a tesla valve.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A plug for use within a wellbore, the plug comprising:
a mandrel; and
a flow restrictor positioned within an inner diameter of the mandrel,
wherein the flow restrictor includes a rotor to actuate a muleshoe positioned in a downhole end of the plug.

2. The plug of claim 1, wherein the muleshoe is threaded and coupled about a rod comprising a downhole end of the rotor.

3. The plug of claim 2, wherein the rod is coupled with another tool downhole of the plug.

4. A system comprising:
a wellbore;
at least one frac plug positioned within a casing of the wellbore, the frac plug including,
a mandrel, the mandrel including one or more components for holding the frac plug in a position within the wellbore casing; and
a flow restrictor positioned within the mandrel,
wherein the flow restrictor includes a rotor to actuate a muleshoe positioned in a downhole end of the frac plug.

5. The system of claim 4, wherein the muleshoe is threaded and coupled about a rod at a downhole end of the rotor, wherein the rod is coupled with another tool downhole of the frac plug.

6. A method comprising:
positioning a frac plug at a depth inside a casing of a wellbore formed in a subsurface formation, wherein one or more components are coupled with the frac plug, the frac plug comprising:
a mandrel; and
a flow restrictor positioned within the mandrel, wherein the flow restrictor includes a rotor to actuate a muleshoe and a rod positioned in a downhole end of the frac plug;
setting the frac plug to contact an inner wall of the casing; and
creating a pressure differential within the wellbore with the flow restrictor of the frac plug.

7. The method of claim 6, wherein creating a pressure differential includes initiating fluid flow through the frac plug, the fluid flow generating rotational motion by the rotor.

8. The method of claim 7, further comprising using the rotational motion of the rotor to perform a downhole operation.

9. A plug for use within a wellbore, the plug comprising:
a mandrel; and
a flow restrictor positioned within an inner diameter of the mandrel,
wherein the flow restrictor comprises a tortuous flow path defined by a geometric pattern, and
wherein the geometric pattern includes a plurality of opposing substantially right angles.

* * * * *